US010253631B2

(12) United States Patent
Van Campfort et al.

(10) Patent No.: US 10,253,631 B2
(45) Date of Patent: Apr. 9, 2019

(54) METHOD FOR EXPANDING A GAS FLOW AND DEVICE THEREBY APPLIED

(71) Applicant: ATLAS COPCO AIRPOWER, NAAMLOZE VENNOOTSCHAP, Wilrijk (BE)

(72) Inventors: Kris Van Campfort, Wilrijk (BE); Kristof Pascal Hubin, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 160 days.

(21) Appl. No.: 15/312,023

(22) PCT Filed: May 11, 2015

(86) PCT No.: PCT/BE2015/000024
§ 371 (c)(1),
(2) Date: Nov. 17, 2016

(87) PCT Pub. No.: WO2015/176145
PCT Pub. Date: Nov. 26, 2015

(65) Prior Publication Data

US 2017/0096897 A1 Apr. 6, 2017

(30) Foreign Application Priority Data

May 19, 2014 (BE) ..... 2014/0375

(51) Int. Cl.
*F01C 20/24* (2006.01)
*F01C 21/10* (2006.01)
(Continued)

(52) U.S. Cl.
CPC ..... *F01C 20/24* (2013.01); *F01C 1/16* (2013.01); *F01C 20/08* (2013.01); *F01C 20/28* (2013.01);
(Continued)

(58) Field of Classification Search
CPC ..... F01C 20/24; F01C 20/28; F01C 21/10; F01C 20/08; F01C 1/16; F01C 21/08
(Continued)

(56) References Cited

U.S. PATENT DOCUMENTS 3,990,244 A * 11/1976 Kruger ..... F01K 3/002 60/660
4,628,462 A * 12/1986 Putman ..... F01K 17/02 60/660
(Continued)

FOREIGN PATENT DOCUMENTS

CA 2644938 A1 5/2012
CN 1274056 11/2000
(Continued)

OTHER PUBLICATIONS

Japanese Office Action in corresponding application JP 2016-568647 dated Jun. 25, 2018.
(Continued)

*Primary Examiner* — Hoang M Nguyen
(74) *Attorney, Agent, or Firm* — Bacon & Thomas, PLLC

(57) ABSTRACT

A method for expanding a gas flow between an inlet for the supply of the gas flow at certain inlet conditions of inlet pressure and inlet temperature and an outlet for the delivery of expanded gas at certain desired outlet conditions of outlet pressure and outlet temperature, whereby this method at least comprises the step of at least partly expanding the gas flow between the inlet and the outlet through a pressure reducing valve and at least partly expanding it through a pressure reducing unit with a rotor driven by the gas for converting the energy contained in the gas into mechanical energy on this shaft.

22 Claims, 4 Drawing Sheets

(51) Int. Cl.

| | |
|---|---|
| ***F01C 1/16*** | (2006.01) |
| ***F01K 13/02*** | (2006.01) |
| ***F01C 20/08*** | (2006.01) |
| ***F01C 20/28*** | (2006.01) |
| ***F01C 21/08*** | (2006.01) |

(52) U.S. Cl.
CPC ..... *F01C 21/08* (2013.01); *F01C 21/10* (2013.01); *F01K 13/02* (2013.01)

(58) Field of Classification Search
USPC ..... 60/660–667
See application file for complete search history.

(56) References Cited

U.S. PATENT DOCUMENTS

| | | | | |
|---|---|---|---|---|
| 5,347,466 | A * | 9/1994 | Nichols | F01K 13/02 60/660 |
| 5,685,154 | A | 11/1997 | Bronicki et al. | |
| 6,237,543 | B1 | 5/2001 | Charoton et al. | |
| 2011/0000180 | A1 | 1/2011 | Yoshinari et al. | |
| 2011/0005228 | A1 | 1/2011 | Yoshinari | |

FOREIGN PATENT DOCUMENTS

| | | | |
|---|---|---|---|
| CN | 1432099 | A | 7/2003 |
| CN | 102852574 | | 1/2013 |
| CN | 101932795 | B | 5/2013 |
| DE | 2706702 | A1 | 8/1978 |
| DE | 10221594 | A1 | 11/2003 |
| EP | 2540995 | A1 | 1/2013 |
| JP | S62-60906 | A | 3/1987 |
| JP | S63-45403 | A | 2/1988 |
| JP | H04-8802 | A | 1/1992 |
| JP | 2008169777 | A | 7/2008 |
| JP | 2009228604 | A | 10/2009 |
| JP | 2012184770 | A | 9/2012 |
| RU | 2012118675 | | 11/2013 |
| SU | 1125393 | | 11/1984 |
| WO | 01/92689 | A1 | 12/2001 |
| WO | 2009060635 | A1 | 5/2009 |
| WO | 2013/136131 | A1 | 9/2013 |

OTHER PUBLICATIONS

Chinese Office Action in corresponding application CN 201580031076.3 dated Jun. 26, 2017.
Russian Office Action in corresponding app. RU 2016149626 dated May 8, 2018.
Official action dated Jun. 26, 2017 in '76.3 application in China.
International Search Report (ISR) dated Oct. 2, 2015, for PCT/BE2015/000024.
Written Opinion dated Oct. 2, 2015, for PCT/BE2015/000024.
Written Opinion dated Apr. 11, 2016, for PCT/BE2015/000024.

* cited by examiner

PRIOR ART

METHOD FOR EXPANDING A GAS FLOW AND DEVICE THEREBY APPLIED

The present invention relates to a method for expanding a gas flow, more specifically a gas or gas mixture such as steam or similar.

BACKGROUND OF THE INVENTION

In an industrial process steam is often used as a driving force or as an inhibitor for all kinds of chemical or other processes.

Steam is generally generated in a boiler whose pressure and temperature are generally fixed.

The industrial process generally requires steam at a lower pressure and temperature than at the output of the boiler, whereby the desired steam conditions can also be variable.

Hence in most steam installations a pressure reducing valve is used between the boiler and the downstream industrial process that allows the steam to expand to the desired pressure required for the industrial process.

Generally saturated steam is used, which by definition does not contain any water in liquid form as all water present in the steam has evaporated into a gas.

It is known that with saturated steam there is an unequivocal link between the pressure and temperature of the steam. In other words, if the temperature of the steam is known, the pressure can also be determined from it and vice versa.

The pressure reducing valve is thereby opened or closed more or less to obtain a pressure that is equal to the pressure required by the downstream process. During expansion, the pressure and temperature of the steam change according to an isenthalpic law known in thermodynamics.

An advantage of such control is that it is very simple.

However, a disadvantage of such control is that the pressure drop is not used for an efficient conversion to another form of energy such as mechanical or electrical energy for example.

Another disadvantage is that it only enables the pressure to be controlled, whereby the isenthalpic expansion in the pressure reducing valve, starting with saturated steam, always supplies superheated steam at a temperature that is generally higher than desired. Superheating of the steam also means an inefficient exchange of heat in the downstream process and consequently must be limited as much as possible.

In order to reduce the temperature of the steam and the level of superheating, traditionally a boiler or 'desuperheater' is used that presents the disadvantage of being expensive and is consequently limited in its capacities.

SUMMARY OF THE INVENTION

The purpose of the present invention is to provide a solution to one or more of the aforementioned and other disadvantages.

To this end the invention concerns a method for expanding a gas flow of a gas or gas mixture such as steam or similar, between an inlet for the supply of the gas to be expanded at certain inlet conditions of inlet pressure and inlet temperature and an outlet for the delivery of expanded gas at certain desired outlet conditions of outlet pressure and outlet temperature, whereby the method at least comprises the step of at least partly expanding the gas flow between the inlet and the outlet through a pressure reducing valve and at least partly expanding it through a pressure reducing unit with a rotor driven by the gas with an outgoing shaft for converting the energy contained in the gas into mechanical energy on this shaft.

By the application of such a pressure reducing unit at least a proportion of the expansion energy can be efficiently converted into mechanical energy on the shaft of the pressure reducing unit, whereby this mechanical energy can be used for example to drive an electricity generator or another useful application.

In contrast to the isenthalpic expansion of the steam in the pressure reducing valve, an expansion in a pressure reducing unit of the intended type proceeds according to a rather polytropic or approximately isentropic thermodynamic law, whereby, compared to an isenthalpic expansion, a polytropic expansion brings about a greater temperature drop for the same pressure drop.

Due to the expansion between the input and output of the device being partly isenthalpic and partly polytropic for the entire flow or for certain parts of the flow, and due to a suitable distribution between isentropic and polytropic expansions, respectively in the pressure reducing valve and in the pressure reducing unit, and/or by a suitable distribution of the subflows, both the pressure and the temperature at the outlet can be adjusted to the values desired by the downstream process, and this without application of additional cooling or a steam cooler and with the additional advantage of being able to draw mechanical energy from the polytropic expansion.

Preferably a screw expander is used as a pressure reducing unit that offers the advantage that it also enables the steam to expand to temperatures below the saturation temperature, whereby steam will partly condense into liquid and which thus enables a wider area of application than with most types of turbines.

According to a preferred variant of the method according to the invention, the gas flow to be expanded is driven through the pressure reducing valve and through the pressure reducing unit in parallel, with a subflow of the gas flow to be expanded that flows through the pressure reducing valve and a subflow that flows through the pressure reducing unit, whereby both subflows are expanded to the desired outlet pressure, after which both subflows are combined at the same desired outlet pressure for the supply of the expanded gas flow at the desired outlet conditions at the outlet.

According to another preferred variant of the method according to the invention the gas flow to be expanded is driven in two successive expansion stages in series through the pressure reducing valve and through the pressure reducing unit, whereby the pressure reducing valve and the pressure reducing unit are controlled such that an intermediate operating point with an intermediate pressure and temperature are obtained after the first expansion stage that ensures an expansion in the second expansion stage to a pressure and temperature corresponding to the desired outlet pressure and outlet temperature.

The invention also relates to a device for expanding a gas flow of a gas or gas mixture such as steam or similar, whereby this device comprises an inlet for the supply of the gas to be expanded at certain inlet conditions of inlet pressure and inlet temperature, and an outlet for the delivery of expanded gas at certain desired outlet conditions of outlet pressure and outlet temperature, whereby the device enables the method according to the invention described above to be applied and which to this end is provided with a pressure reducing valve and a pressure reducing unit with a rotor driven by the gas with an outgoing shaft for converting the energy contained in the gas into mechanical energy on this shaft and pipes to guide the gas flow to be expanded at least partly through the pressure reducing valve and at least partly through the pressure reducing unit.

The advantages are the same as those described for the method applied according to the invention.

BRIEF DESCRIPTION OF THE DRAWINGS

With the intention of better showing the characteristics of the present invention, a few preferred applications of a method according to the invention for expanding a gas flow and a device thereby applied are described hereinafter by way of an example, without any limiting nature, with reference to the accompanying drawings, wherein.

DETAILED DESCRIPTION OF THE INVENTION

Figure 1:
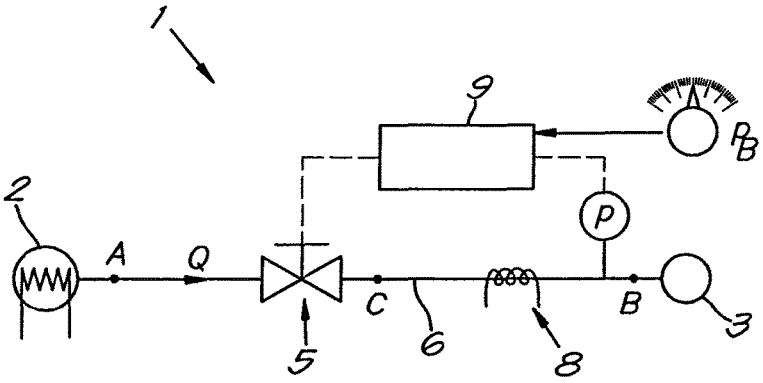
Fig. 1 PRIOR ART
FIG. 1 schematically shows a conventional known device for expanding a gas flow, more specifically steam.

The conventional device 1 shown in FIG. 1 is provided with an inlet A that connects to a source 2 of steam for the supply of a gas flow Q of steam to be expanded and an outlet B for the delivery of expanded steam to a downstream steam device 3 of steam consumers or industrial process.

The source 2 is a boiler for example that produces saturated steam at certain inlet conditions, i.e. a certain inlet pressure $p_A$ and inlet temperature $T_A$ at the input A of the device 1.

The operating point of the steam in the inlet A is shown in the phase diagram as the point A located on the saturation curve 4 of the phase diagram, whereby this saturation curve 4 forms the separation between the zone of the gas phase G on the one hand where the temperature and pressure of the steam are such that the steam only occurs in the gas phase of water, and the zone G+V where the gas phase of water is in equilibrium with the liquid phase of water.

The isobar of constant pressure $p_A$ that goes through the operating point A is indicated in the phase diagram as a dashed line and presents all operating points for which the pressure is equal to the inlet pressure $p_A$.

When energy is supplied starting from a point on the isobar $p_A$ to the left of the saturation line, then the operating point will move along the horizontal section of the isobar $p_A$ towards the right at a constant temperature $T_A$ and the water droplets present will gradually evaporate until the operating point A is reached where all the water has evaporated and only gas remains.

With the further supply of energy at constant pressure $p_A$, the operating point will move further to the right along the isobar $p_A$ and the temperature will gradually rise. In this zone it is a case of superheated steam corresponding to a gas phase without liquid.

The downstream steam device 3 determines the steam conditions that the steam supplied must satisfy, in other words the steam conditions at the output B of the device 1, in particular the outlet pressure $p_B$, outlet temperature $T_B$ and composition of the steam.

Generally slightly superheated steam is desired for the downstream steam device 3. The corresponding operating point is shown in the phase diagram as a point B to the right of the saturation line 4 at a pressure $p_B$ that is lower than the pressure $p_A$, and a temperature $T_B$ that is lower than $T_A$.

In order to expand the steam from the pressure $p_A$ at the inlet A to the lower pressure $p_B$ at the outlet B, conventionally use is made of a pressure reducing valve 5 that is incorporated in a pipe 6 that connects the inlet A to the outlet B to expand a flow of steam Q through the pressure reducing valve 5.

For a conventional pressure reducing valve 5, this expansion to the outlet pressure $p_B$ proceeds essentially according to an isenthalpic development along the isenthalpic expansion curve 7 up to the point C on the isobar $p_B$.

The temperature $T_C$ is generally much higher than the desired outlet temperature $T_B$, and so after the pressure reducing valve 5 a steam cooler 8 or similar is used to reduce the outlet temperature to the desired temperature $T_B$ at constant pressure $p_B$. The operating point then moves along the isobar $p_B$ from point C to point B.

In the example shown of a conventional device 1, the pressure reducing valve 5 is adjustable and provided with a controller 9 to control the expansion through the pressure reducing valve 5 to a desired pressure value $p_B$ set in the controller 9, whereby the controller 9 continuously measures the pressure at the outlet B and opens the pressure reducing valve 5 more or less as the pressure is greater or smaller than the set pressure $p_B$ until the pressure is equal to the aforementioned set pressure.

Figure 3:
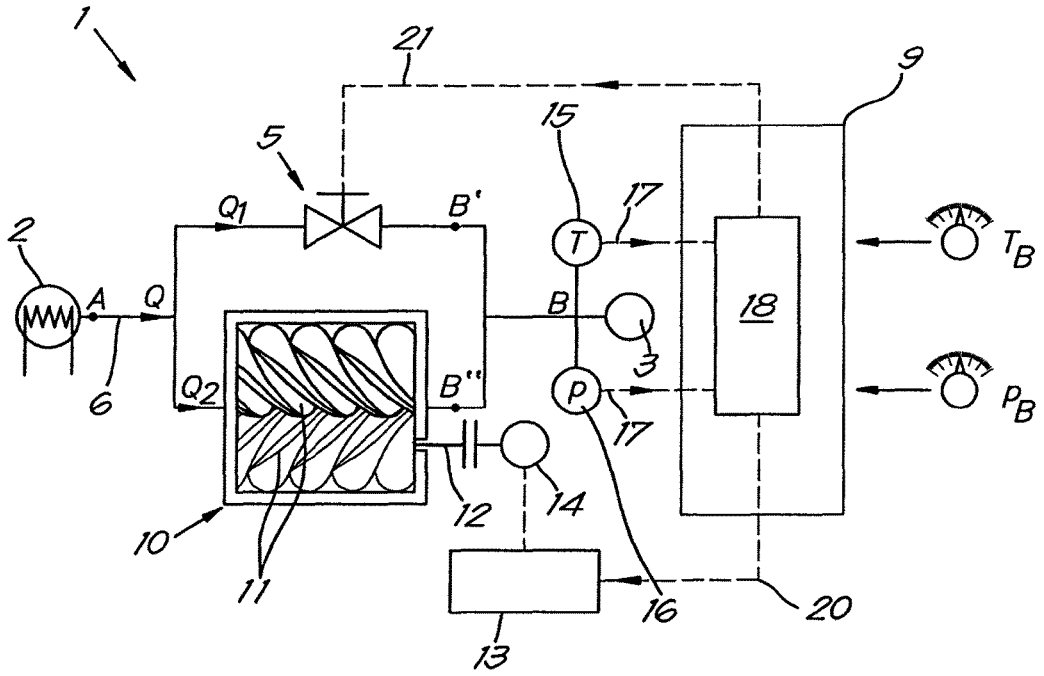
FIG. 3 shows a device according to the invention for expanding steam.

FIG. 3 shows a device 1 according to the invention that differs from the conventional device of FIG. 1, for example in the fact that no steam cooler 8 has to be provided and that in the pipe 6, in addition to the pressure reducing valve 5, a pressure reducing unit 10 is also incorporated in parallel so that the steam flow Q is split into a subflow $Q_1$ that is guided through the pressure reducing valve 5, and a subflow $Q_2$ that flows through the pressure reducing unit 10, whereby these subflows $Q_1$ and $Q_2$, after expansion, are combined again to be supplied together via the output B to the downstream steam device.

The pressure reducing unit is preferably constructed as a screw expander with two meshed rotors 11 of which one rotor 11 is provided with an outgoing shaft 12 for conversion of the expansion energy of the steam into mechanical energy that is available on the shaft 12.

By way of an example, the outgoing shaft 12 is coupled to an electricity generator 14 for the delivery of electricity to a consumer network (not shown).

The speed of the pressure reducing unit 10 is preferably variably adjustable, to which end the generator 14 is provided with a controller 13 for example.

Other forms of pressure reducing units with at least one driven rotor and outgoing shaft are not excluded, for example one or another type of turbine.

The device 1 according to the invention is provided with means 15 and 16, respectively for measuring or determining the temperature and pressure at the outlet B.

Furthermore the device of FIG. 3 comprises a controller 9 for controlling the expansions that the steam undergoes in the pressure reducing valve 5 and in the pressure reducing unit 10 to obtain steam in the outlet B at the desired, set or settable values of the outlet pressure $p_B$ and outlet temperature $T_B$ in the controller as a function of the inlet conditions $p_A$ and $T_A$ that are presumed to be constant here.

The controller 9 is connected via the connections 17 to the aforementioned means 15 and 16 for determining the pressure and temperature at the outlet B and has a control algorithm 18 to split the flow Q into the two aforementioned subflows $Q_1$ and $Q_2$ that both undergo an expansion separately to the desired outlet pressure $p_B$.

Figure 4:
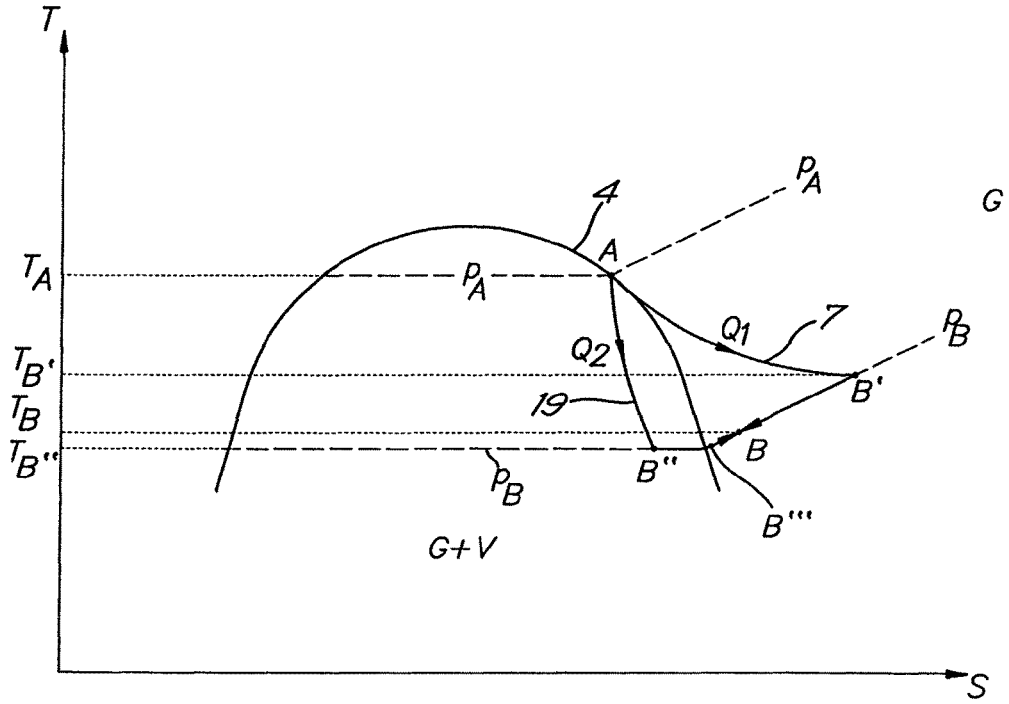
FIG. 4 shows a phase diagram such as that of FIG. 2, but for the device of FIG. 3.

The expansion of the subflow $Q_2$ in the screw expander taken as an example typically proceeds according to an approximately isentropic or polytropic law, as illustrated in FIG. 4 by the expansion curve 19.

The flow thereby changes from the operating point A at the inlet A to the operating point B" at the outlet B" of the pressure reducing unit 10, whereby this operating point B" is located on the isobar $p_B$.

It can be derived from the phase diagram that the temperature $T_B$" at the outlet B" is lower than the desired temperature $T_B$.

Figure 2:
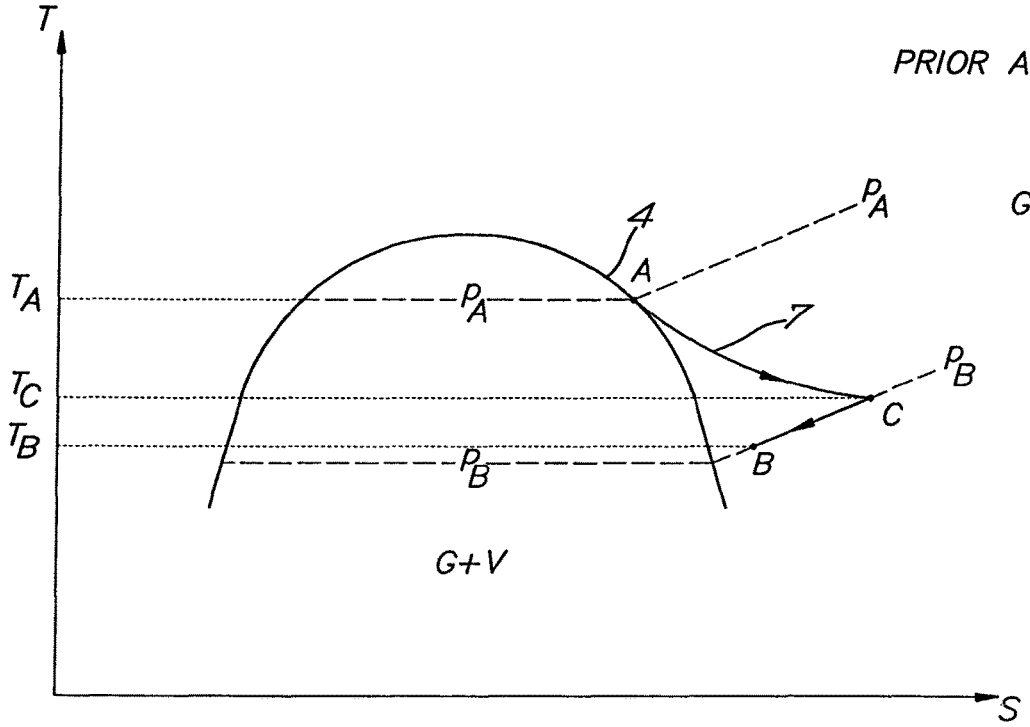
FIG. 2 shows a phase diagram or steam diagram in the form of a temperature/entropy diagram of steam, with the development of the steam during its passage in the device indicated thereon.

The expansion of the subflow $Q_1$ in the pressure reducing valve 5 typically proceeds according to an isenthalpic law that proceeds in an analogous way to FIG. 2 according to an expansion curve 7 between the operating point A at the inlet and an operating point B' at the outlet of the pressure reducing valve 5, located on the isobar $p_B$.

The temperature $T_B$' at the outlet B' of the pressure reducing valve 5 is thereby higher than the desired set temperature $T_B$.

After expansion both subflows $Q_1$ and $Q_2$ are combined with a pressure $p_B$, whereby a combined flow Q occurs at the outlet B with a pressure $p_B$ and a temperature that is between the temperatures $T_B$' and $T_B$" and which depends on the mutual mixing ratios of both subflows $Q_1$ and $Q_2$. The control algorithm 18 of the controller 9 is such that the mutual mixing ratio between $Q_1$ and $Q_2$ can be controlled such that the temperature of the combined flow Q corresponds to the desired temperature $T_B$.

To this end the controller 9, is connected on the one hand to the controller 13 via a connection 20 to be able to adjust the speed and thereby also the flow $Q_2$ of the pressure reducing unit 10 and, on the other hand, is connected to the controllable pressure reducing valve 5 via a connection 21 in order to open or close this pressure reducing valve 5 more or less in order to let more or less flow $Q_1$ through.

The control algorithm 18 can be designed as follows for example.

When starting the device 1 the flow Q is distributed equally for example into a flow $Q_1$ through the pressure reducing valve 5 and a flow $Q_2$ through the pressure reducing unit 10, whereby $Q_1=Q_2=Q/2$.

In the first instance the combined flow Q is controlled on the basis of the pressure measured at the outlet B. When the measured pressure is lower than the set value of the desired outlet pressure $p_B$ this means that the flow Q is too low and the subflows $Q_1$ and $Q_2$ are increased to an equal extent until the measured pressure is equal to the set pressure $p_B$. Analogously, when the measured pressure is higher than the set value $p_B$, the subflows $Q_1$ and $Q_2$ are reduced to an equal extent until the measured pressure is equal to the set pressure $p_B$.

The steam through the pressure reducing valve 5 follows curve 7 up to point B', while the steam through the pressure reducing unit 10 follows the curve 19 up to point B". The combination of both flows leads to a point B'" that differs from the demanded temperature $T_B$.

If the temperature B'" is lower than temperature $T_B$, as is the case of FIG. 4, too much steam is expanded via curve 19. Hence the algorithm 18 will ensure that the flow $Q_1$ increases and the flow $Q_2$ decreases to the same extent until the desired temperature $T_B$ is reached.

As the total combined flow Q is not affected by this initial control, with constant inlet conditions, the outlet pressure will be maintained at $p_B$.

If, on the other hand, the temperature B'" is higher than the desired temperature $T_B$, then this means that too much steam is expanded via curve 7. That is why in this case the algorithm 18 will ensure that the flow $Q_1$ decreases and the flow $Q_2$ increases to the same extent until temperature $T_B$ is reached.

If for example the downstream consumers in the steam device 3 now require less flow Q, then the outlet pressure $p_B$ will increase if the device 1 still supplies the flow Q. Then the controller 18 will change the flow Q, upon detection of a change in the outlet pressure, so that the ratio of the flows $Q_1/Q_2$ applicable at the time is maintained.

As soon as the correct outlet pressure $p_B$ is reached the algorithm 18 will then check whether the ratio of the flows $Q_1/Q_2$ must be changed to realise the desired temperature $T_B$ at the outlet B.

Upon a change of other conditions such as inlet pressure or inlet temperature the algorithm 18 will also proceed in the same way, i.e.:

first the demanded outlet pressure $p_B$ is realised by adjusting the total flow Q;

then the ratio between the flow Q1 and flow Q2 is adjusted to realise the demanded outlet temperature $T_B$.

Of course there can be additional branches and tap-offs in the device that further divide the flow Q or subflows $Q_1$ and/or $Q_2$ to again be entirely or partially combined afterwards in proportions determined by the controller in order to get the desired outlet conditions.

It is clear that the conditions at the inlet A do not need to be limited to points on the saturation curve 4, but in the inlet it can also start with slightly superheated steam with an operating point to the right of the curve 4 or a slight two-phase mixture of steam and water droplets with an operating point to the left of the curve 4, to nonetheless still be able to make use of the advantages of the invention.

Figure 5:
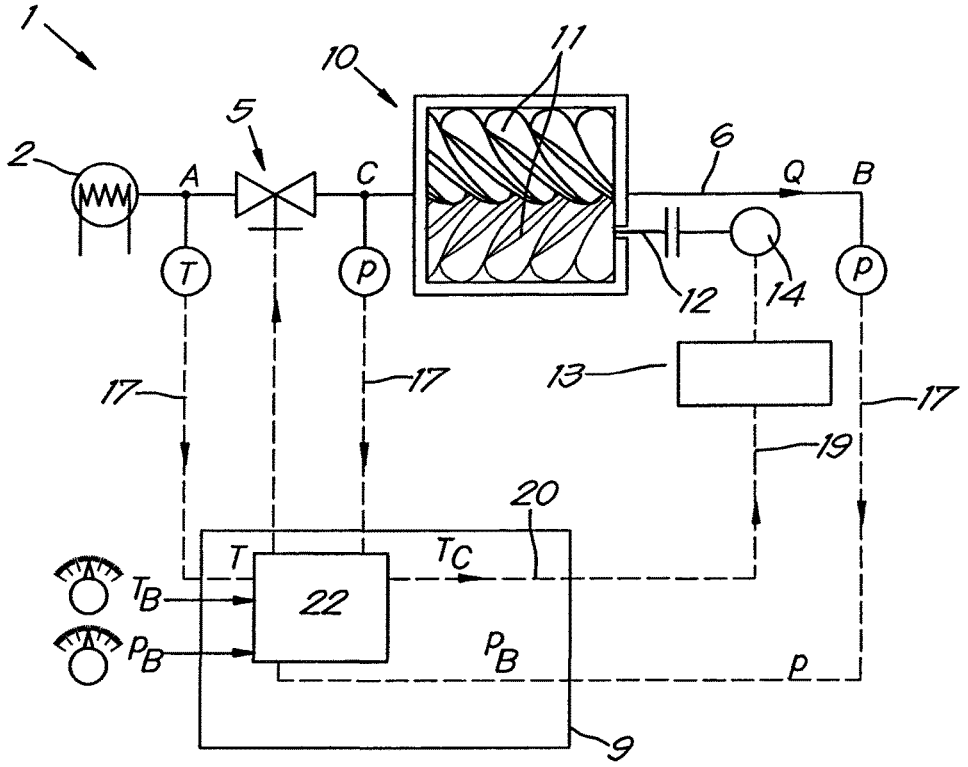
FIG. 5 shows a variant of a device according to the invention.

FIG. 5 shows an alternative device 1 according to the invention in which the pressure reducing valve 5 and the pressure reducing unit 10, in the example a screw expander coupled to a generator 14, in this case are not incorporated in parallel in the pipe 6 such as in the embodiment of FIG. 3, but in series after one another as two successive expansion stages between the inlet A and the outlet B, respectively in the pressure reducing valve 5 from the pressure $p_A$ at the inlet A to an intermediate pressure $p_C$ in the pipe 6 between the pressure reducing valve 5 and the pressure reducing unit 10, and then in the pressure reducing unit 10 from the intermediate pressure $p_C$ to the desired outlet pressure $p_B$.

Figure 6:
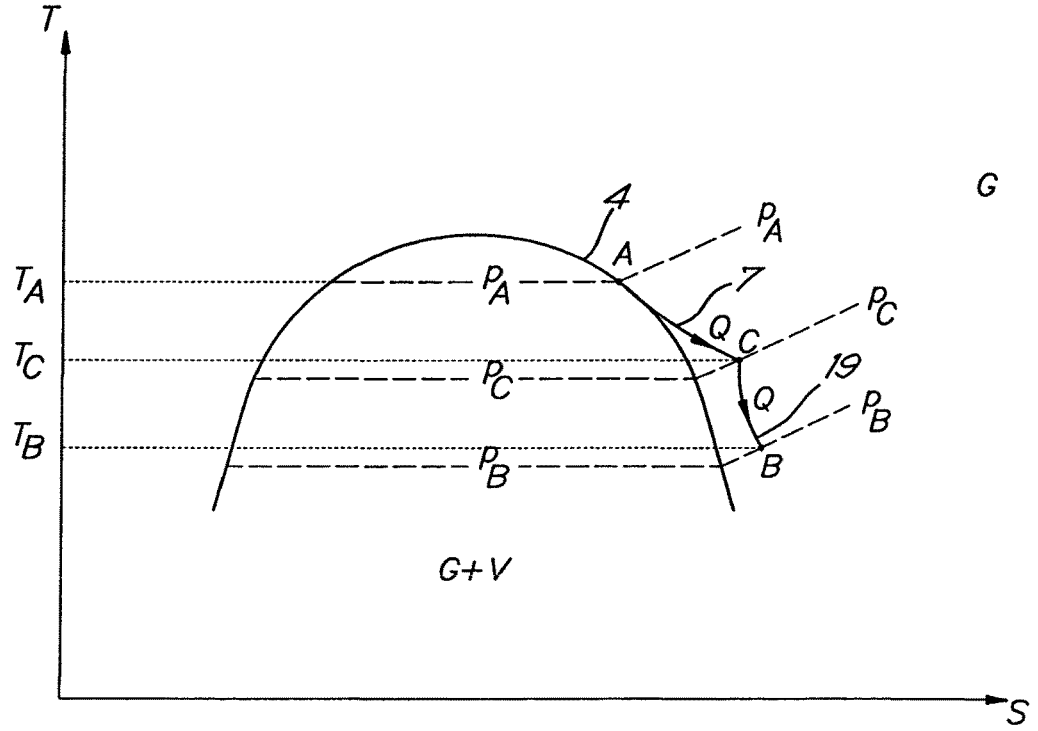
FIG. 6 shows a diagram such as that of FIG. 4 for the device of FIG. 5.

As shown in FIG. 6 expansion in the pressure reducing valve 5 then follows the isenthalpic expansion curve 7 from the operating point A at the inlet A to the intermediate operating point C at a pressure $p_C$ and temperature $T_C$ and the further expansion in the pressure reducing unit 10 proceeds according to a polytropic or approximately isentropic expansion curve 19 to the operating point B for the outlet B.

A suitable controller 9 makes it possible to control both expansion stages such that the pressure and temperature at the outlet B is equal to a set value $p_B$ and $T_B$ in the controller 9.

The controller 9 comprises a computation and control algorithm 22 that determines the course of the expansion curves 7 and 19 as a function of the known inlet conditions $p_A$ and/or $T_A$ and as a function of the desired outlet conditions $p_B$ and/or $T_B$, and then determines the operating point C as a section of both expansion curves 7 and 19. This operating point C corresponds to the intermediate operating point that is desired to be reached between both expansion stages to reach the desired pressure $p_B$ and temperature $T_B$ at the outlet for the given inlet conditions $p_A$ and $T_B$.

The control algorithm 22 provides the following control for example.

During a first control step the flow Q is adjusted until the desired pressure $p_B$ is reached in the outlet B.

To this end when starting up the device 1 the pressure reducing unit 10 is controlled at a minimum speed by adjusting the load of the generator 14 via the controller 13 and the pressure reducing valve 5 is thereby systematically opened.

When the opening proceeds slowly in the beginning a very large pressure drop will occur across the pressure reducing valve 5, such that the intermediate pressure at the intermediate operating point C' will be much lower than the desired interim pressure $p_C$. The flow Q will generally be expanded via the expansion curve 7 and to a lesser extent via the expansion curve 19.

Figure 7:
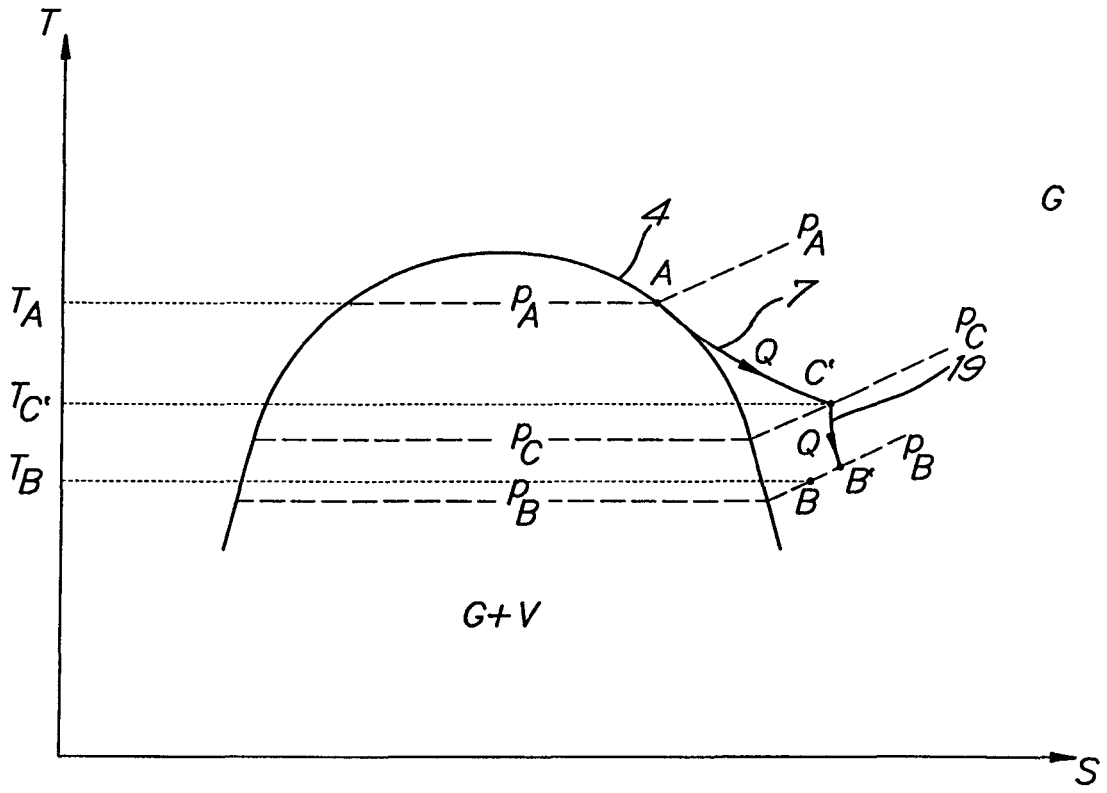
FIG. 7 shows the diagram of FIG. 6 during an intermediate control.

The control algorithm 22 will gradually further open the expansion valve 5 at constant speed of the pressure reducing unit 10 until the demanded outlet pressure $p_B$ is reached as shown in FIG. 7.

The operating point B' is characterised by an outlet temperature that is higher than the desired outlet temperature $T_B$.

During a second control step the interim pressure of the intermediate operating pressure C is adjusted while preserving the flow rate, and this in the following way for example.

When the interim pressure is lower than the desired interim pressure $p_C$, then the algorithm will increase the speed of the pressure reducing unit 10 until the desired interim pressure $p_C$ is reached.

However, when the interim pressure is higher than the desired interim pressure $p_C$, the algorithm will close the pressure reducing valve 5 more until the desired interim pressure $p_C$ is reached.

If the downstream consumers now demand less flow Q for example, the outlet pressure in the outlet B will increase if the device still supplies a flow Q. That is why the controller 9, when detecting a change in the outlet pressure in the outlet B, will change the flow Q such that the interim pressure $p_C$ is preserved. This can be done in the case of a lower required flow by simultaneously closing the pressure reducing valve 5 and reducing the speed of the pressure reducing unit 10 according to a certain ratio.

As soon as the desired outlet pressure $p_B$ is reached the algorithm will then check whether the state of the pressure reducing valve 5 and/or the speed of the pressure reducing unit 10 must be changed to realise the calculated desired interim pressure $p_C$.

It is not excluded that the algorithm comprises a step that refines the calculated interim pressure $p_C$ on the basis of the difference between the measured outlet temperature and the desired outlet temperature $T_B$ for the case when an inaccuracy in the algorithm or ageing of the machine occurs.

Upon a change of other conditions such as inlet pressure or inlet temperature the algorithm will always proceed in the same way, i.e.:

first the desired outlet pressure $p_B$ is realised by adjusting the total flow Q;

then the ratio between the opening of the pressure reducing valve 5 and the speed of the pressure reducing unit 10 is adjusted to realise the calculated interim pressure pC.

It is clear that the order of the pressure reducing valve 5 when the pressure reducing unit 10 in series can also be swapped over and that more than two stages can also be provided.

Depending on the complexity of the industrial process it is not excluded that a combination of one or more parallel connections such as that of FIG. 3 and/or of one or more serial connections such as that of FIG. 5 is applied with a suitable controller for this purpose of course.

Although a screw expander is used in each of the examples described above, it is not excluded using other types of expanders. An advantage of a screw expander it is less sensible to the formation of water droplets during the expansion, such as in the case of FIG. 4 in which the operating point B" or the intermediate operating point C is located in the zone where gas and liquid are in equilibrium.

Instead of steam other gases or gas mixtures can also be used.

The present invention is by no means limited to the variants of a method and device for expanding a gas flow described as an example and shown in the drawings, but a method and a device according to the invention can be realised in all kinds of variants without departing from the scope of the invention.

The invention claimed is:

1. A method for expanding a gas flow of a gas or gas mixture between an inlet for the supply of the gas to be expanded at certain inlet conditions of inlet pressure and inlet temperature and an outlet for the delivery of expanded gas at certain desired outlet conditions of outlet pressure and outlet temperature, the method at least comprising the steps of:

at least partly expanding the gas flow between the inlet and the outlet through a pressure reducing valve and at least partly expanding the gas flow through a pressure reducing unit with a rotor driven by the gas with an outgoing shaft for converting the energy contained in the gas into mechanical energy, and controlling a first subflow of the gas flow to be expanded to flow through the pressure reducing valve and a second subflow to flow through the pressure reducing unit, wherein the gas flow to be expanded is driven through the pressure reducing valve and through the pressure reducing unit in parallel, and wherein a controller is configured to control the flow and expansion of the first and second subflows, and the first and second subflows are controlled separately to a desired, set outlet pressure, after which the first and second subflows are combined at the same desired, set outlet pressure for the supply of the expanded gas flow at the desired outlet conditions at the outlet.

2. The method according to claim 1, wherein the gas supplied to the inlet is essentially saturated vapour or a slightly superheated vapour or a slightly two-phase mixture of vapour and liquid.

3. The method according to claim 1, wherein the expansion is allowed to proceed up to the outlet conditions of the expanded gas to be supplied that correspond to the conditions of an essentially saturated vapour or a slightly superheated vapour.

4. The method according to claim 1, wherein the pressure reducing unit is a screw expander.

5. The method according to claim 4, wherein the expansion is allowed to proceed to the outlet conditions of the expanded gas to be supplied that correspond to the conditions of a vapour that is in equilibrium with a small quantity of droplets.

6. The method according to claim 1, wherein the gas flow to be expanded is split in such a way into the first subflow that flows through the pressure reducing valve and the second subflow that flows through the pressure reducing unit that, upon the combination of the subflows, each with a pressure equal to the desired, set outlet pressure but with an outlet temperature that is different to the desired outlet temperature, a combined temperature is obtained that is equal to a desired outlet temperature.

7. The method according to claim 1, wherein to split the gas flow to be expanded the pressure reducing valve and/or the speed of the pressure reducing unit is or are adjusted to allow more or less gas through.

8. The method according to claim 6, wherein when starting up the controller to a desired operating point at the outlet, the gas flow to be expanded is split into the aforementioned subflows according to a fixed ratio, and is preferably split into two equal subflows.

9. The method according to claim 8, wherein for the control the total combined flow is first adjusted by increasing or decreasing both subflows according to the aforementioned fixed ratio until the pressure in the outlet is equal to the desired, set outlet pressure.

10. The method according to claim 9, wherein:

when the pressure in the outlet is lower than the desired, set pressure, the subflows are increased until the pressure in the outlet is equal to the desired, set outlet pressure; or that when the pressure in the outlet is greater than the desired, set pressure, the subflows are decreased until the pressure in the outlet is equal to the desired, set outlet pressure.

11. The method according to claim 9, wherein the ratio of the subflows is then adjusted while preserving the total flow obtained in order to obtain the desired outlet temperature.

12. The method according to claim 11, wherein the ratio of the subflows is adjusted:

when the temperature in the outlet is lower than the desired outlet temperature, by increasing the first subflow that is allowed through the pressure valve and decreasing the second subflow that is allowed through the pressure reducing unit to the same extent, until the temperature in the outlet is equal to the desired outlet temperature; or that, when the temperature in the outlet is higher than the desired outlet temperature, by decreasing the first subflow that is allowed through the pressure reducing valve and increasing the second subflow that is allowed through the pressure reducing unit to the same extent, until the temperature in the outlet is equal to the desired outlet temperature.

13. A method for expanding a gas flow of a gas or gas mixture between an inlet for the supply of the gas to be expanded at certain inlet conditions of inlet pressure and inlet temperature and an outlet for the delivery of expanded gas at certain desired outlet conditions of outlet pressure and outlet temperature, wherein the method at least comprises the steps of:

at least partly expanding the gas flow between the inlet and the outlet through a pressure reducing valve and at least partly expanding the gas flow through a pressure reducing unit with a rotor driven by the gas with an outgoing shaft for converting the energy contained in the gas into mechanical energy, and controlling the pressure reducing valve and the pressure reducing unit, wherein a controller is configured to control the flow and expansion of the gas flow such that after the first expansion stage an intermediate operating point with an intermediate pressure and temperature is obtained that ensures an expansion in the second expansion stage to a pressure and temperature corresponding to a desired, set outlet pressure and outlet temperature, wherein the gas flow to be expanded is driven in two successive expansion stages in series through the pressure reducing valve and through the pressure reducing unit.

14. The method according to claim 13, wherein the intermediate pressure and intermediate temperature are determined on the basis of a computation algorithm whereby the expansion curve of the first expansion stage is determined on the basis of the inlet conditions and the expansion curve of the second expansion stage is determined on the basis of the desired, set outlet pressure and outlet temperature, whereby a desired intermediate operating point is determined as a section between both expansion curves.

15. The method according to claim 14, wherein the desired, set outlet pressure in the outlet is first realized by controlling the total flow Q and then the desired calculated intermediate pressure in the intermediate operating point is realized by adjusting the ratio between the opening of the pressure reducing valve and the speed of the pressure reducing unit.

16. The method according to claim 15, wherein when starting up the device the pressure reducing unit is controlled at a minimum speed and the pressure reducing valve is thereby systematically opened until the desired, set outlet pressure is reached.

17. The method according to claim 16, wherein the interim pressure of the intermediate operating pressure is controlled:

when the interim pressure is lower than the desired interim pressure, by increasing the speed of the pressure reducing unit until the desired interim pressure is reached, or, when the interim pressure is higher than the desired interim pressure, by closing the pressure reducing valve until the desired interim pressure is reached.

18. The method according to claim 14, wherein the first expansion stage is the pressure reducing valve, followed by the pressure reducing unit as the second expansion stage.

19. A device for expanding a gas flow of a gas or gas mixture said device comprising:

said inlet for the supply of the gas to be expanded at certain inlet conditions of inlet pressure and inlet temperature, and said outlet for the delivery of expanded gas at certain desired outlet conditions of outlet pressure and outlet temperature, wherein the device enables the method according to claim 1 to be applied and which to this end is provided with said pressure reducing valve and said pressure reducing unit with said rotor driven by the gas with said outgoing shaft for converting the energy contained in the gas into mechanical energy and said pipes to guide the gas flow to be expanded at least partly through the pressure reducing valve and at least partly through the pressure reducing unit, wherein the pressure reducing valve and/or the pressure reducing unit is or are controllable, and wherein the device is provided with a controller with an algorithm for controlling the pressure reducing valve and the pressure reducing unit in such a way that the outlet pressure and the outlet temperature of the first and second subflows are separately controlled to correspond to the desired, set pressure and temperature set in the controller.

20. The device according to claim 19, wherein the pressure reducing valve has an adjustable passage.

21. The device according to claim 19, wherein the pressure reducing unit is a screw expander with an adjustable speed.

22. The device according to claim 19, wherein the aforementioned pipes are such that the gas flow to be expanded is guided from the inlet through the pressure reducing valve and the pressure reducing unit in parallel or in series to the outlet.

* * * * *